US006056354A

United States Patent [19]

Tseng

[11] Patent Number: 6,056,354

[45] Date of Patent: May 2, 2000

[54] FOLDABLE CHAIR FRAME

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 09/097,132

[22] Filed: Jun. 12, 1998

[51] Int. Cl.[7] ..... A47C 4/24

[52] U.S. Cl. ..... 297/56; 297/55

[58] Field of Search ..... 297/56, 55, 29, 297/53; 108/120, 119

[56] References Cited

U.S. PATENT DOCUMENTS

| | | | |
|---|---|---|---|
| 530,564 | 12/1894 | Walton | 297/53 |
| 1,121,744 | 12/1914 | McLaughlin | 108/120 X |
| 2,247,236 | 6/1941 | Johannsen | 297/56 X |
| 2,794,492 | 6/1957 | Hamilton | 297/56 |
| 2,912,775 | 11/1959 | Gettelman | 108/120 X |
| 3,381,998 | 5/1968 | Cheshier et al. | 297/53 X |
| 4,611,823 | 9/1986 | Haas | 108/119 X |
| 5,447,319 | 9/1995 | Huang | 108/120 X |
| 5,765,802 | 6/1998 | Bostrom et al. | 248/575 |

FOREIGN PATENT DOCUMENTS

| | | | |
|---|---|---|---|
| 494045 | 3/1950 | Belgium | 297/56 |
| 1941803 | 2/1971 | Germany | 297/56 |
| 35026 | 10/1934 | Netherlands | 297/56 |
| 6602 | 6/1896 | Sweden | 297/56 |
| 292823 | 6/1928 | United Kingdom | 297/56 |

*Primary Examiner*—Peter M. Cuomo
*Assistant Examiner*—David E. Allred
*Attorney, Agent, or Firm*—Ladas & Parry

[57] ABSTRACT

A foldable chair frame includes a seat frame formed with an elongated groove which extends from a front end portion to a rear end portion of the seat frame, a first leg frame pivoted to the seat frame, and a second leg frame pivoted to the first leg frame and formed with a slide member that extends slidably into the elongated groove. When in an unfolded state, the slide member extends along the elongated groove to the front end portion of the seat frame. When in a folded state, the slide member extends along the elongated groove to the rear end portion of the seat frame. A locking unit includes a stop member disposed below the seat frame and mounted pivotally to the front end portion of the seat frame about a horizontal pivot axis. The stop member is formed with an upwardly extending stop protrusion. A biasing member biases the stop member to move the stop protrusion upwardly adjacent to the elongated groove to arrest rearward movement of the slide member along the elongated groove when the chair frame is in the unfolded state, thereby preventing untimely folding of the chair frame.

2 Claims, 8 Drawing Sheets

FOLDABLE CHAIR FRAME

BACKGROUND OF THE INVENTION

1. Field of the Invention

This invention relates to a foldable chair frame, more particularly to a foldable chair frame which is provided with a locking unit to prevent untimely folding of the chair frame.

2. Description of the Related Art

Foldable chairs are widely popular due to their reduced sizes after folding which facilitate transport and storage thereof. However, in recent years, user safety has become an important consideration in the design of foldable chairs. As such, much attention has been paid to provide a foldable chair that can be positioned in an unfolded state and that can be prevented from untimely folding to ensure safety of the user seated thereon.

SUMMARY OF THE INVENTION

The main object of the present invention is to provide a foldable chair frame which can be positioned securely in an unfolded state.

Accordingly, the foldable chair frame of the present invention includes a seat frame, first and second leg frames, and a locking unit. The seat frame has front and rear end portions, and is formed with an elongated groove which extends from the front end portion to the rear end portion. The first leg frame extends forwardly and downwardly from the rear end portion of the seat frame, and has an upper end mounted pivotally to the rear end portion of the seat frame, a lower end adapted to be supported on a ground surface, and an intermediate section between the upper and lower ends. The second leg frame has an upper end formed with a slide member that extends slidably into the elongated groove of the seat frame, a lower end adapted to be supported on the ground surface, and an intermediate section pivoted to the intermediate section of the first leg frame. The chair frame is movable between an unfolded state, in which the seat frame is substantially horizontal, and the slide member of the second leg frame extends along the elongated groove to the front end portion of the seat frame, and a folded state, in which the seat frame is substantially upright, and the slide member of the second leg frame extends along the elongated groove to the rear end portion of the seat frame. The locking unit is mounted on the seat frame, and includes a stop member and a biasing member. The stop member is disposed below the seat frame and is mounted pivotally to the front end portion of the seat frame about a horizontal pivot axis. The stop member is formed with an upwardly extending stop protrusion. The biasing member biases the stop member so that the stop protrusion moves upwardly and is adjacent to the elongated groove to arrest rearward movement of the slide member along the elongated groove when the chair frame is in the unfolded state, thereby preventing untimely folding of the chair frame. The stop member is operable to move the stop protrusion downwardly away from the elongated groove against biasing action of the biasing member so as to permit rearward movement of the slide member along the elongated groove for folding the chair frame.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
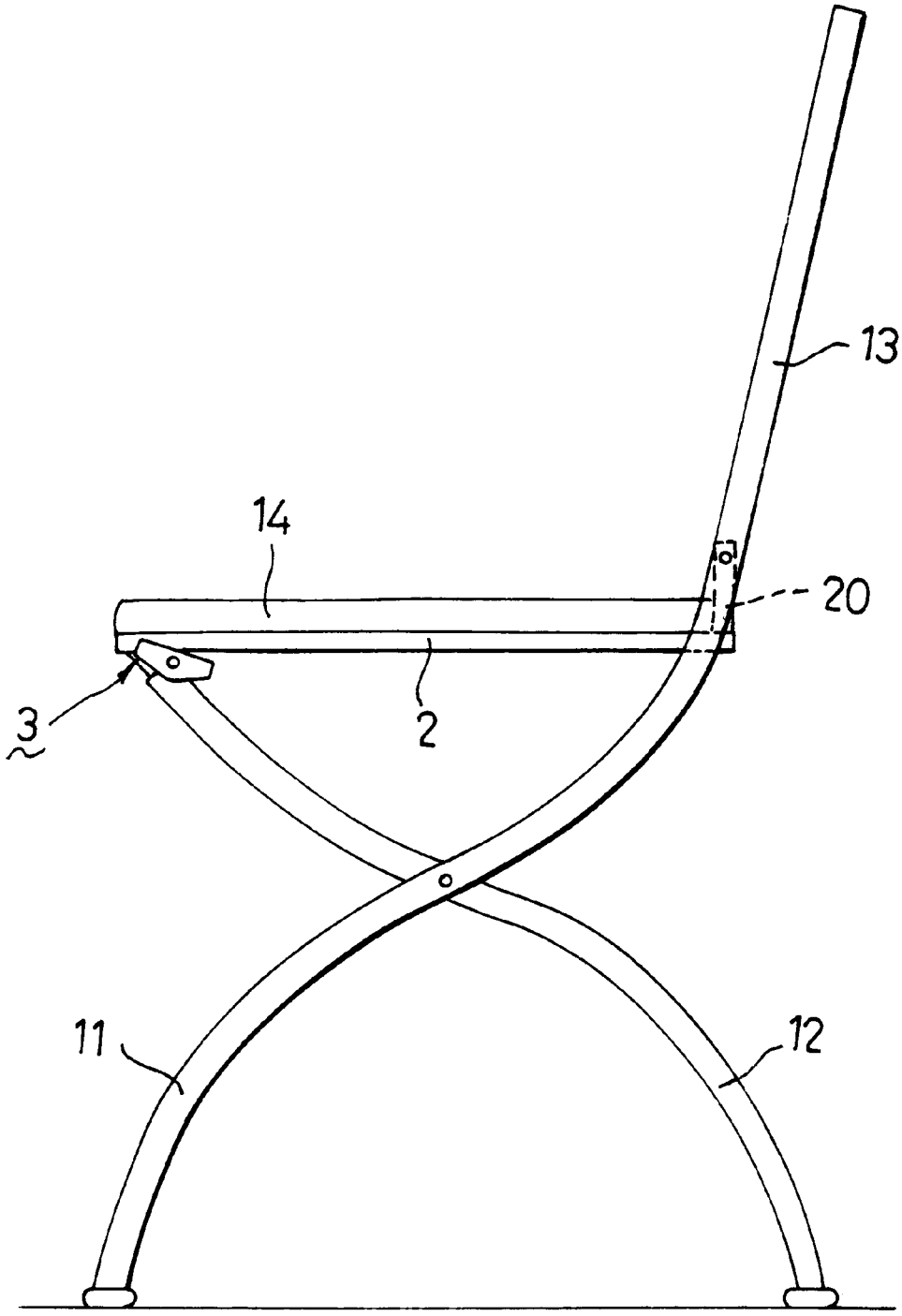
FIG. 1 is a side view illustrating a first preferred embodiment of a foldable chair frame according to the present invention when in an unfolded state.
Figure 2:
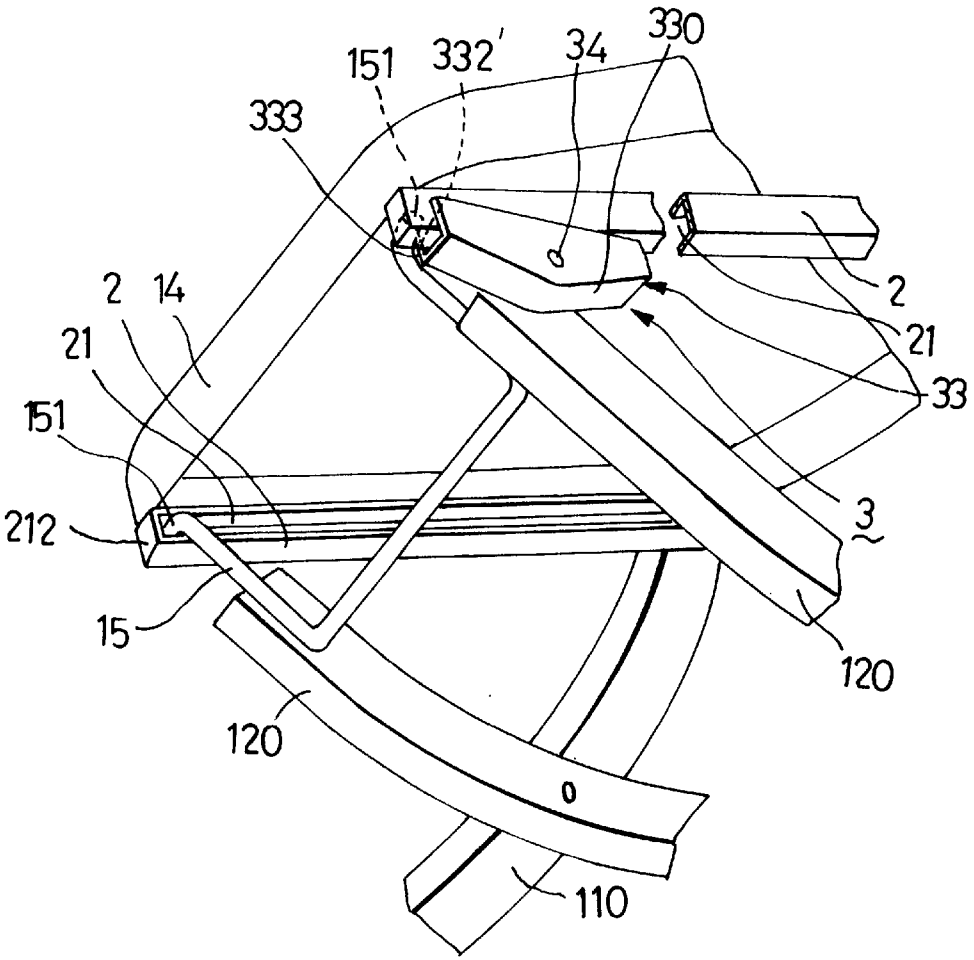
FIG. 2 is a fragmentary bottom perspective view of the first preferred embodiment when the chair frame is positioned in the unfolded state.

Referring to FIGS. 1 and 2, the foldable chair frame of the first preferred embodiment according to the present invention is shown to generally include a seat frame 14, first and second leg frames 11, 12, a backrest frame 13, and a locking unit 3.

The seat frame 14 includes a parallel pair of lateral rails 2, each of which has a front end portion, a rear end portion formed with a pivot plate 20 that is generally transverse to the lateral rail 2, and an inner side formed with an elongated groove 21 that extends from the front end portion to the rear end portion and that is formed between front and rear end walls (only the front end wall 212 is shown in FIG. 2) of the lateral rail 2.

The first leg frame 11 includes a parallel pair of first legs 110, each of which has an upper end mounted pivotally to the pivot plate 20 in the rear end portion of a respective one of the lateral rails 2, and a lower end adapted to be supported on a ground surface. Each of the first legs 110 extends forwardly and downwardly from the rear end portion of a respective one of the lateral rails 2 of the seat frame 14. The backrest frame 13 extends integrally and upwardly from the upper ends of the first legs 110.

The second leg frame 12 includes a parallel pair of second legs 120, each of which has an upper end, and a lower end adapted to be supported on the ground surface. Each of the second legs 120 is pivoted to an adjacent one of the first legs 110 at intermediate sections thereof to form a cross-shaped formation when the chair frame is unfolded. The second leg frame 12 further includes a U-shaped connecting rod 15 which extends transversely between the second legs 120 and which is fixed to the second legs 120, such as by welding. The connecting rod 15 has two upwardly extending, opposed distal ends, each of which is formed with a slide member 151 that is transverse to the second legs 120 and that extends slidably into the elongated groove 21 of an adjacent one of the lateral rails 2 for sliding along the elongated groove 21 when folding and unfolding the chair frame.

Figure 3:
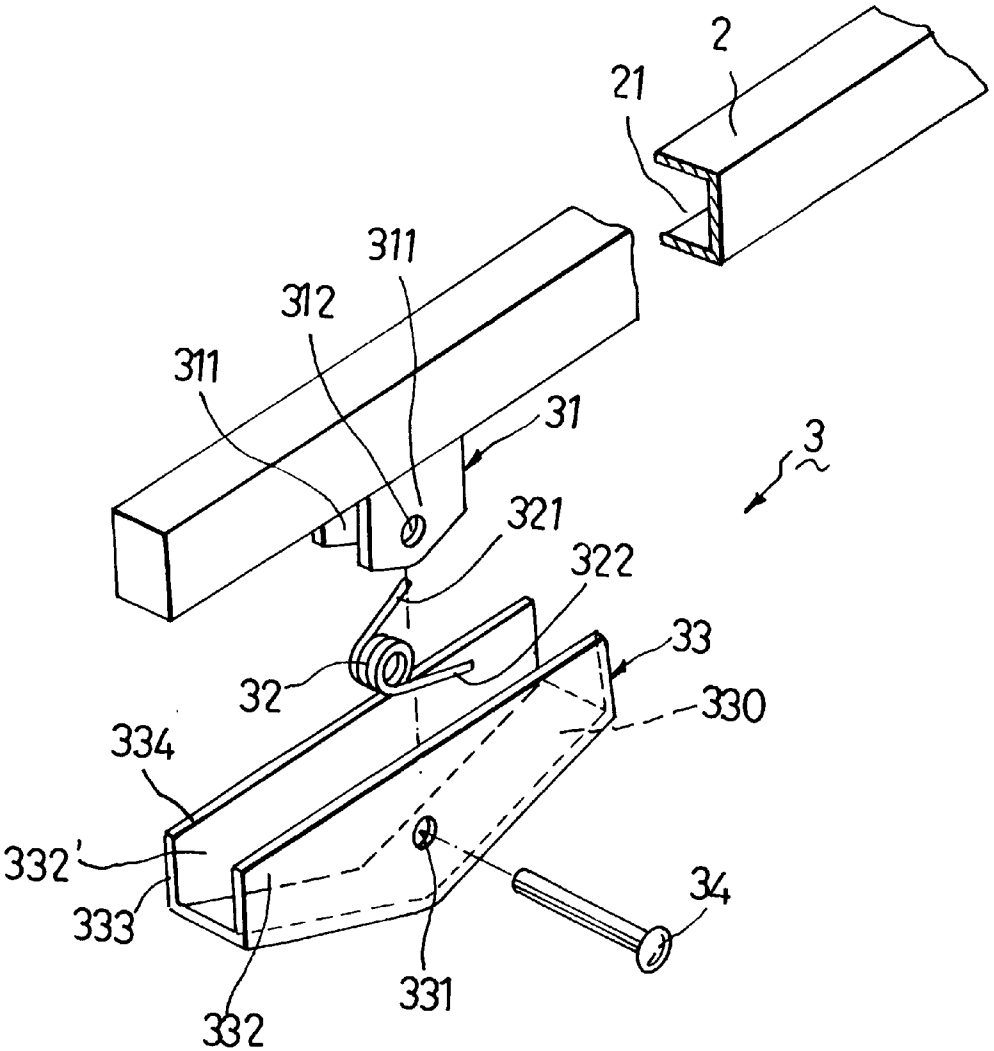
FIG. 3 is an exploded perspective view illustrating a locking unit in the chair frame of the first preferred embodiment.

Referring to FIGS. 2 and 3, the locking unit 3 includes a pivot seat 31, a biasing member 32, a stop member 33, and a pivot pin 34.

The pivot seat 31 is mounted on a bottom side of one of the lateral rails 2 at the front end portion of the latter, and has a parallel pair of pivot lobes 311 that extend downwardly from the front end portion of the lateral rail 2 and that is formed with aligned pivot holes 312.

The stop member 33 has a substantially horizontal abutment wall 330 and parallel and flat inner and outer side plates 332', 332 which project upwardly from the abutment wall 330 and which are formed with aligned pivot holes 331. The stop member 33 is disposed below the lateral rail 2 so that the pivot lobes 311 of the pivot seat 31 are disposed between the inner and outer side plates 332', 332 of the stop member 33. The pivot pin 34 extends in a horizontal direction through the pivot holes 331, 312 to mount the stop member 33 pivotally to the pivot seat 31 and to divide the stop member 33 into a front section that extends forwardly of the pivot pin 34, and a rear section that extends rearwardly of the pivot pin 34. The biasing member 32 is in the form of a torsion spring and is disposed between the pivot lobes 311. The biasing member 32 has the pivot pin 34 extending therethrough so that an upper end 321 of the biasing member 32 abuts against the bottom side of the lateral rail 2, and so that a lower end 322 of the same abuts against the abutment wall 330 at the rear section of the stop member 33 to bias the rear section of the stop member 33 downwardly, thereby resulting in upward pivoting movement of the front section of the stop member 33. The front section of the inner side plate 332' serves as a stop protrusion which moves upwardly adjacent to an open side of the elongated groove 21 of the adjacent lateral rail 2 due to the biasing action of the biasing member 32. The stop protrusion 332' has a vertical first edge 333 and a horizontal second edge 334 which inclines downwardly and rearwardly relative to the elongated groove 21 when the stop protrusion 332' is biased upwardly by virtue of the biasing member 32.

When the chair frame is in an unfolded state, as shown in FIG. 1, the seat frame 14 is substantially horizontal, the slide members 151 (see FIG. 2) extend along the elongated grooves 21 to the front end portions of the lateral rails 2 and abut against the front end walls 212 of the lateral rails 2, and the first and second leg frames 11, 12 form a cross-shaped formation. Under this situation, the stop protrusion 332' is disposed adjacent to the open side of the corresponding elongated groove 21 and on a rear side of the corresponding slide member 151. The first edge 333 of the stop protrusion 332' abuts against the slide member 151 to arrest rearward movement of the slide member 151 along the elongated groove 21, thereby preventing untimely folding of the chair frame.

Figure 4:
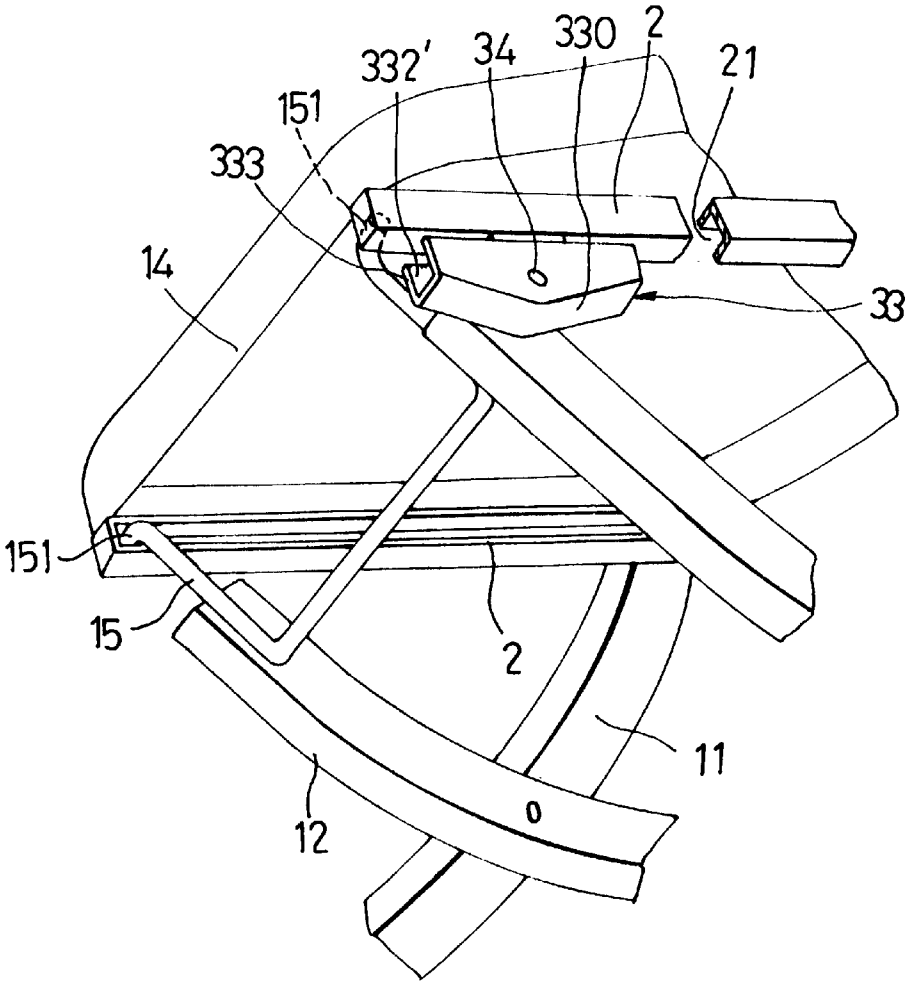
FIG. 4 is a fragmentary bottom perspective view of the first preferred embodiment when the locking unit is operated to permit folding of the chair frame.
Figure 5:
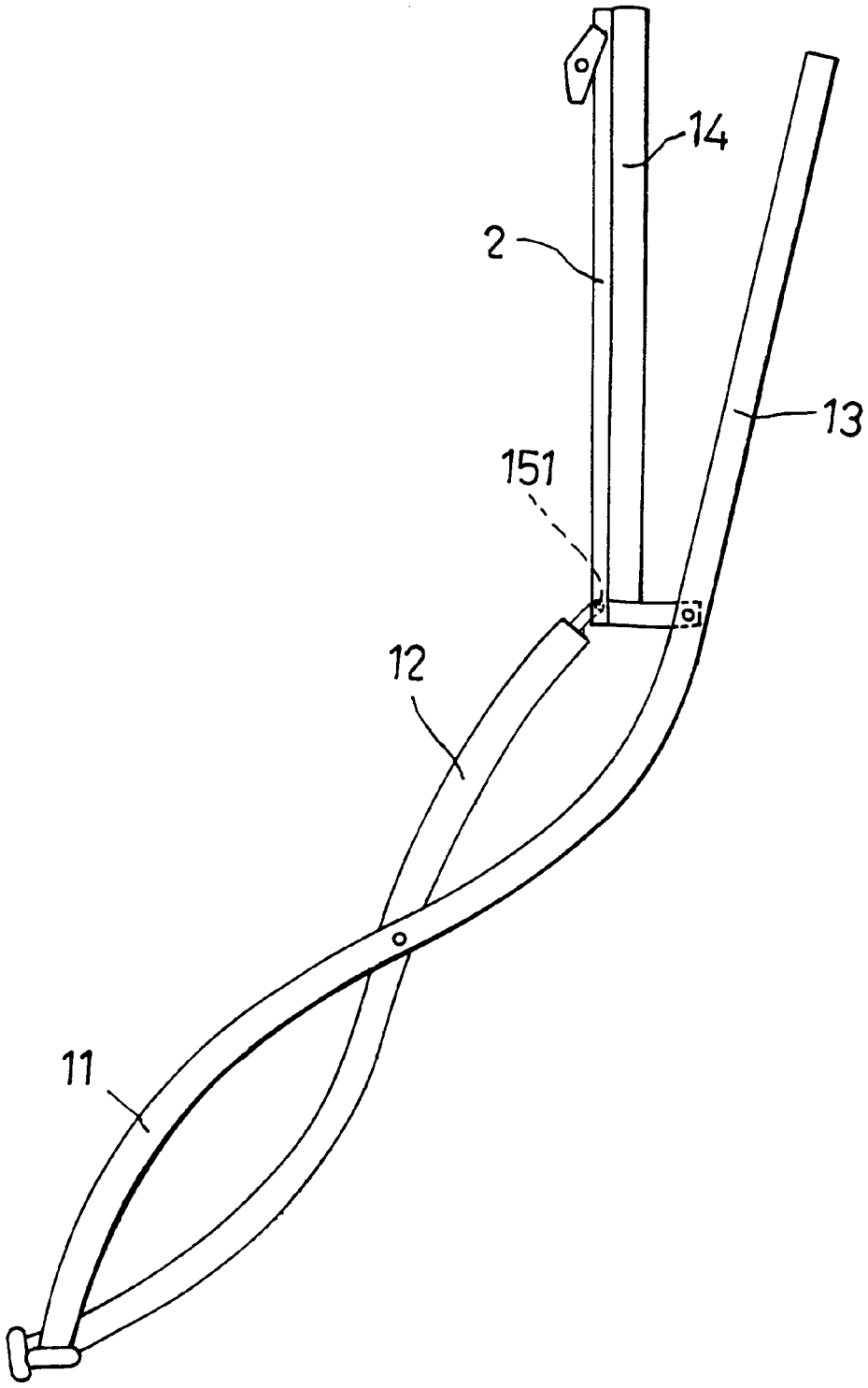
FIG. 5 is a side view illustrating the first preferred embodiment when in a folded state.

Referring to FIGS. 4 and 5, to fold the chair frame, the abutment wall 330 at the rear section of the stop member 33 is lifted upwardly against the action of the biasing member 32 to move the stop protrusion 332' away from the adjacent elongated groove 21 and from the adjacent slide member 151, thereby permitting rearward movement of the slide members 151 along the grooves 21 to the rear end portions of the lateral rails 2 and to abut against the rear end walls of the lateral rails 2. In the folded state, the seat frame 14 is turned substantially upright for folding on the backrest frame 13, the slide members 151 extend along the elongated grooves 21 to the rear end portions of the lateral rails 2 of the seat frame 14, and the second leg frame 12 is folded on the first leg frame 11.

When it is desired to unfold the chair frame from the folded state shown in FIG. 5, the seat frame 14 is turned forwardly, and the second leg frame 12 is unfolded from the first leg frame 11. At this time, the slide members 151 move forwardly along the elongated grooves 21. Since the second edge 334 (see FIG. 3) of the stop protrusion 332' is inclined relative to the adjacent elongated groove 21 due to the biasing action of the biasing member 32, the slide member 151 slides past the second edge 334 and pushes the front section of the stop member 33 downwardly against the biasing action of the biasing member 32 for moving to the front end portion of the lateral rail 2. The unfolding operation of the chair frame is thus completed.

Figure 6:
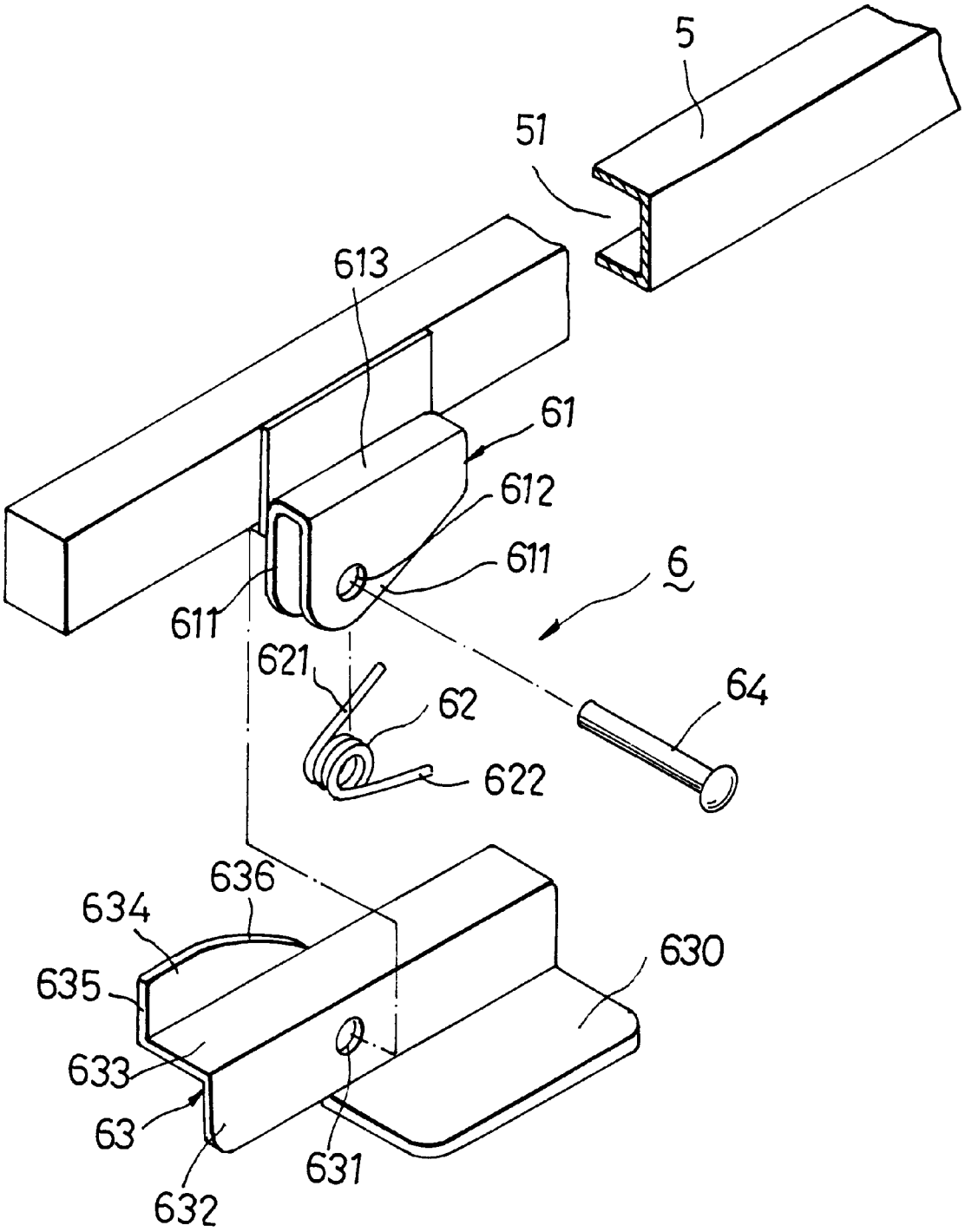
FIG. 6 is an exploded perspective view of a locking unit of a foldable chair frame of a second preferred embodiment of the present invention.
Figure 7:
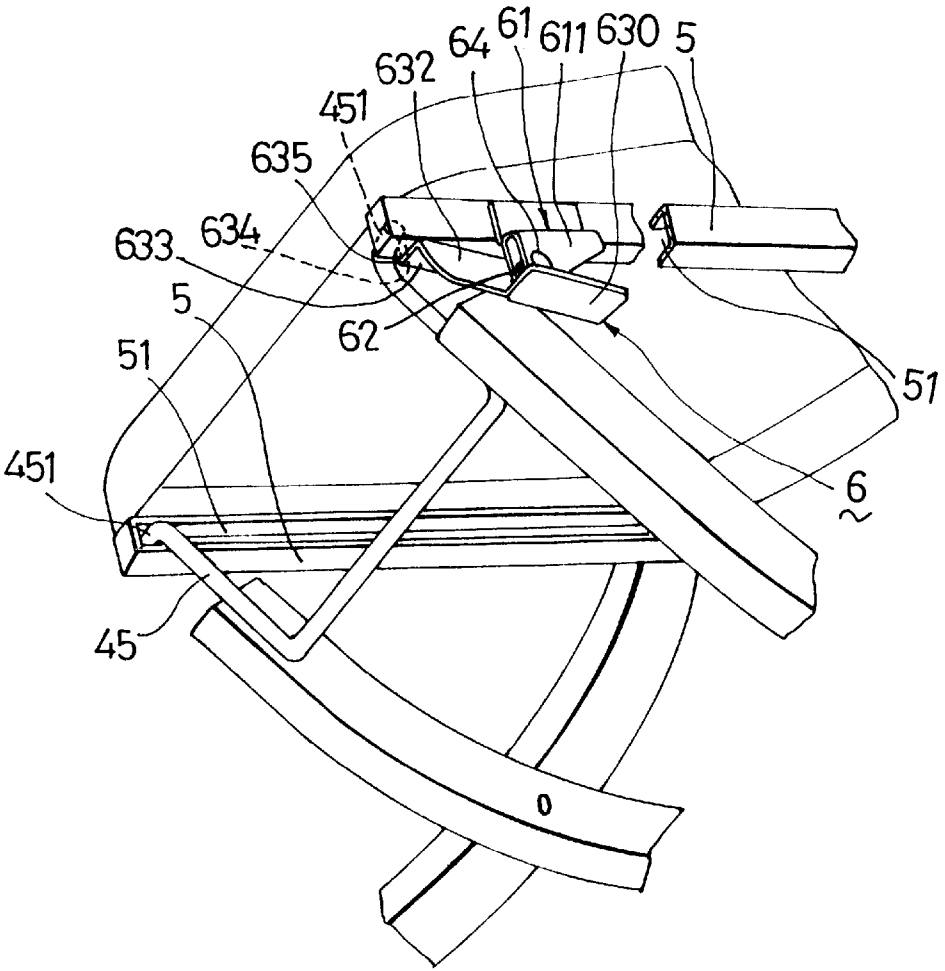
FIG. 7 is a fragmentary bottom perspective view of the second preferred embodiment when the chair frame is positioned in an unfolded state.

Referring to FIGS. 6 and 7, the second preferred embodiment of the foldable chair frame according to the present invention is shown to also include a seat frame having a parallel pair of lateral rails 5 which are each formed with an elongated groove 51, a first leg frame pivoted to the seat frame, a second leg frame pivoted to the first leg frame to form a cross-shaped formation when the chair frame is unfolded, and a U-shaped connecting rod 45 fixed to the second leg frame and having two distal ends formed with transverse slide members 451 that extend slidably and respectively into the elongated grooves 51. The main difference between the first and second preferred embodiments resides in the construction of the locking unit 6. In this embodiment, the locking unit 6 includes a pivot seat 61, a biasing member 62, and a stop member 63.

The pivot seat 61 is fixed to one of the lateral rails 5 of the seat frame on an outer lateral side thereof, and includes a horizontal top wall 613 and a parallel pair of pivot lobes 611 which extend downwardly from the top wall 61 and which project downwardly relative to the lateral rail 5. The pivot lobes 611 are formed with aligned pivot holes 612.

The stop member 63 is disposed below the lateral rail 5 and has a horizontal abutment wall 630, a first connecting wall 632 extending upwardly from an inner longitudinal edge of the horizontal abutment wall 630, a second connecting wall 633 extending horizontally from a top edge of the first connecting wall 632, and a stop protrusion 634 which is formed as an upright flat plate that extends upwardly from an inner longitudinal edge of the second connecting wall 633. The first connecting wall 632 is formed with a pivot hole 631. The stop protrusion 634 has a vertical first edge 635, and a curved second edge 636 which inclines downwardly and rearwardly from a top end of the first edge 635. The stop member 63 is mounted on the pivot seat 61 so that the pivot lobes 611 are disposed on top of the abutment wall 630 and on an outer side of the first connecting wall 632. A pivot pin 64 extends through the pivot holes 631, 612, and divides the stop member 63 into a front section that extends forwardly of the pivot pin 64, and a rear section that extends rearwardly of the pivot pin 64. As shown, the stop protrusion 634 is formed at the front section of the stop member 63, and the horizontal abutment wall 630 is formed at the rear section of the stop member 63.

The biasing member 62, in the form of a torsion spring, is disposed between the pivot lobes 611 and has the pivot pin 64 extending therethrough so that the biasing member 62 has an upper end 621 biasing the top wall 613 of the pivot seat 61, and a lower end biasing the horizontal abutment wall 630 of the stop member 63. Thus, the biasing member 62 biases the rear section of the stop member 63 downwardly, thereby resulting in upward pivoting movement of the front section about the pivot pin 64 and causing the stop protrusion 634 to move upwardly adjacent to an open side of the adjacent elongated groove 51.

When the chair frame is in an unfolded state, as shown in FIG. 7, the stop protrusion 634 is disposed adjacent to the open side of the adjacent elongated groove 51 and on a rear side of an adjacent one of the slide members 451. The first edge 635 of the stop protrusion 634 abuts against the slide member 451 to arrest rearward movement of the slide member 451 along the elongated groove 51, thereby preventing untimely folding of the chair frame.

Figure 8:
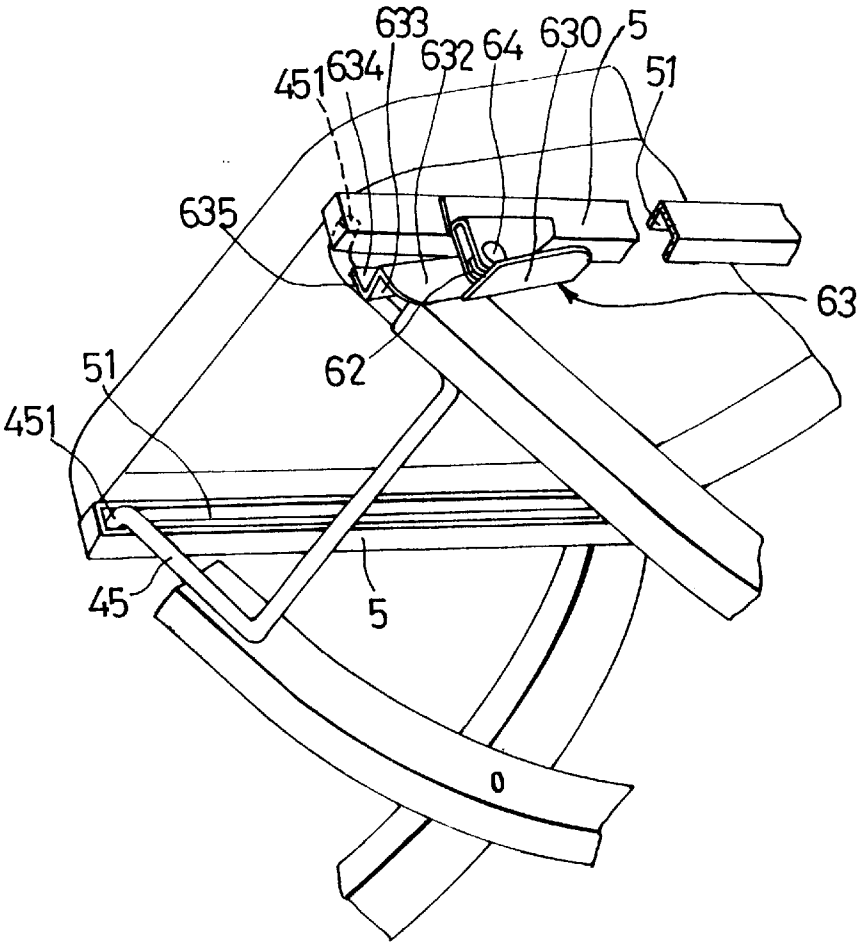
FIG. 8 is a fragmentary bottom perspective view of the second preferred embodiment when the locking unit is operated to permit folding of the chair frame.

Referring to FIG. 8, to fold the chair frame, the horizontal abutment wall 630 at the rear section of the stop member 63 is lifted upwardly against the biasing action of the biasing member 62 to move the stop protrusion 634 downwardly away from the adjacent elongated groove 51 and away from the adjacent slide member 451, thereby permitting rearward movement of the slide member 451 along the elongated groove 51 for folding the chair frame.

Likewise, when it is desired to unfold the chair frame, the seat frame is turned forwardly, and the second leg frame is unfolded from the first leg frame. At this time, the slide members 451 move forwardly along the elongated grooves 51. Since the second edge 636 of the stop protrusion 634 is an inclined curved edge, the slide member 451 adjacent to the stop member 63 slides past the second edge 636 and pushes the front section of the stop member 63 downwardly against the biasing action of the biasing member 62 for moving to the front end portion of the lateral rail 5. The unfolding operation of the chair frame is thus completed.

Accordingly, the foldable chair frame of the present invention can be prevented from untimely folding in an effective manner when it is in an unfolded state. Moreover, by merely stretching the seat frame away from the backrest frame, the chair frame can be unfolded and then positioned in the unfolded state without the need for operating the locking unit.

With this invention thus explained, it is apparent that numerous modifications and variations can be made without departing from the scope and spirit of this invention. It is therefore intended that this invention be limited only as indicated in the appended claims.

I claim:

1. A foldable chair frame, comprising:

a seat frame having a front end portion and a rear end portion, and being formed with a pair of elongated grooves which extend from said front end portion to said rear end portion;

a first leg frame which extends forwardlv and downwardly from said rear end portion of said seat frame, said first leg frame having an upper end mounted pivotally to said rear end portion of said seat frame, a lower end adapted to be supported on a ground surface, and an intermediate section between said upper and lower ends;

a second leg frame which has an upper end formed with a pair of slide members slidably projecting into said elongated grooves of said seat frame, a lower end adapted to be supported on the ground surface, and an intermediate section pivotably coupled to said intermediate section of said first leg frame;

said chair frame being movable between an unfolded state, in which said seat frame is substantially horizontal, and said slide members of said second leg frame reside within said elongated grooves proximate said front end portion of said seat frame, and a folded state, in which said seat frame is substantially upright, and said slide members of said second leg frame reside within said elongated grooves proximate said rear end portion of said seat frame; and a locking unit mounted on said seat frame and including:

a stop member disposed below said seat frame and mounted pivotally to said front end portion of said seat frame about a horizontal pivot axis, said stop member being formed with an upwardly extending stop protrusion, and a biasing member for applying a biasing force to said stop member such that the application of said biasing force to said stop member movably disposes said stop protrusion to a point adjacent one of said elongated grooves so as to impede sliding movement of one of said slide members residing in said one of said elongated grooves away from said front end portion of said seat frame along said one of said elongated grooves when said chair frame is in said unfolded state, thereby preventing untimely folding of said chair frame, and such that the application to said stop member of a force in opposition to said biasing force movably disposes said stop protrusion to a point distal said one of said elongated grooves so as to permit sliding movement of said one of said slide members away from said front end portion of said seat frame along said one of said elongated grooves, when said chair frame is to be folded into said folded state, said locking unit further including a pivot seat having a parallel pair of pivot lobes that extend downwardly from said front end portion of said seat frames and a pivot pin extending through said stop member and said pivot lobes for mounting said stop member pivotally to said seat frame, said stop member including a front section extending forwardly of said pivot pin, and a rear section extending rearwardly of said pivot sin, said stop member being formed with a horizontal abutment wall, at said rear section, said stop protrusion being formed at said front section, said biasing member being formed as a torsion spring which is disposed between said pivot lobes and which has said pivot pin extending therethrough, said torsion spring having one end abutting against said seat frame and another end abutting against said horizontal abutment wall for biasing said rear section downwardly, thereby resulting in upward pivoting movement of said front section about said pivot pin to result in upward movement of said stop protrusion, said stop protrusion being formed as a flat upright plate, and having a first edge which abuts against said one of said slide members to prevent rearward movement of said one of said slide members in said one of said elongated grooves when said chair frame is in the unfolded state.

2. The foldable chair frame according to claim 1, wherein said first edge of said stop protrusion is substantially vertical, said stop protrusion further having a second edge that inclines rearwardly and downwardly from a top end of said first edge to permit said one of said slide members to slide past second edge and push said front section of said stop member downwardly against biasing action of said biasing member when said chair frame is unfolded.

* * * * *